United States Patent [19]

Radcliffe

[11] Patent Number: 4,980,974

[45] Date of Patent: Jan. 1, 1991

[54] CONTOURED SHAVING BLADES

[76] Inventor: Allan F. Radcliffe, 12459 Floresta Ct., San Diego, Calif. 92128

[21] Appl. No.: 350,756

[22] Filed: May 11, 1989

[51] Int. Cl.[5] ..... B26B 21/00

[52] U.S. Cl. ..... 30/50; 30/84; 30/356

[58] Field of Search ..... 30/47, 48, 49, 50, 84, 30/356, 351

[56] References Cited

U.S. PATENT DOCUMENTS

| | | | |
|---|---|---|---|
| 950,820 | 3/1910 | Hygonnet | 30/49 |
| 1,324,010 | 12/1919 | Hyman | 30/340.57 |
| 2,983,045 | 5/1961 | Diatikar, Jr. | 30/49 |
| 4,069,580 | 1/1978 | Cartwright, Jr. et al. | 30/50 X |
| 4,168,570 | 9/1979 | Bakker | 30/43.6 |
| 4,208,791 | 6/1980 | Van Cleve | 30/49 |
| 4,318,223 | 3/1982 | Bergsma | 30/43.6 |
| 4,516,320 | 5/1985 | Peleckis | 30/50 X |
| 4,663,843 | 5/1987 | Savage | 30/48 |
| 4,754,548 | 7/1988 | Solow | 30/50 |

*Primary Examiner*—Frank T. Yost
*Assistant Examiner*—Willmon Fridie, Jr.
*Attorney, Agent, or Firm*—Andsel Group, Inc.

[57] ABSTRACT

A conventional shaving razor having one or more vertically stacked razor blades. Each upper blade having the same length but a width less than that of the lower blade. The cutting edges of each double-edged blade is contoured on approximately a six inch radius. The rear cutting edge of each blade contoured concavely on approximately a six inch radius. The contoured cutting edges providing a smooth shave over the curved surface of the body being shaved.

10 Claims, 1 Drawing Sheet

CONTOURED SHAVING BLADES

BACKGROUND OF THE INVENTION

1. Field of the Invention

This invention relates to razor heads wherein the razor blade is contoured to provide a selection of arcuate surfaces such as a convex, and a concave cutting edge allowing a choice of cutting edges to provide a smooth shave over curved surfaces of the portion of the body being shaved.

2. Description of the Prior Art

The prior art describes several approaches to the problem of closely shaving convex and concave surfaces of the skin. U.S. Pat. No. 1,324,010 Hyman, describes a rigid, straight edged razor employing a square shaped blade having four cutting edges of different curvature two straight edges, a concave edge and a convex edge. U.S. Pat. No. 4,208,791 Van Cleve, describes an arcuate head safety razor shaped to conform to convex and concave body surfaces. The two separate cutting edges on inclined surfaces one above the other. Other prior art designs include a method of clamping one edge of a safety razor blade to remain straight while the other end was mechanically distorted to provide an arcuate edge.

SUMMARY OF THE INVENTION

The instant invention relates to a conventional safety razor wherein the blades have contoured cutting edges accommodating the configuration of the skin surfaces being shaved. The top cutting edge of the blade being convex for inward curved skin surfaces such as the underarm area and the bottom cutting edge being concave for the outward curved skin surfaces such as the calf of the leg. The concave edge will be the leading edge when the razor is pulled in the standard shaving motion. The blades are stacked vertically in uniform alignment and separated by a flat spacer element of a width less than that of the blade. The blades and the spacers are of the same length.

The trailing or convex edge of the razor cutting edge is employed by turning the razor handle axis 180 degrees. Employment of the convex edge is better enabled to be used and enhanced by the approximate 30 degree bend found on the blade end of modern shaving device handles. One or more blades can be utilized with the razor by diminishing the depth of each added blade so as to present the clean cutting edge to the area being shaved.

A shaving razor head described herein has a plurality of blades stacked vertically in uniform alignment on a razor base and the blades are separated by a flat spacer element of a width less than that of the blade. Each succeeding blade has a width smaller than the adjacent lower blade and a retainer plate has a width less than the topmost blade.

There are a plurality of ports through the razor base, the blades, the spacers and the retainer plate and a plurality of retainers extending through the ports and intimately securing the retainer plate, the blades and the spacers to the razor base. The razor blades being double-edged with one cutting edge being contoured longitudinally and convexly inward, and with an other cutting edge contoured longitudinally and concavely outward.

The shaving razor head may have a handle attached to the razor base to assist the user in using the head to shave. The handle may be attached to the razor base at an approximate angle of 25 to 35 degrees. The blades and spacers may be approximately the same length. The double-edged blade edges may be contoured on approximately a six inch parallel radius or they may be contoured on nonparallel radii. The retainers may be rivets.

It is therefore an object of this invention to provide a shaving razor head that has both a convex and a concave blade edge on the same blade and a handle at an approximate angle of 30 degrees that provides a shaving apparatus that is primarily designed for women, the concave rear edge being for the underarm area and the convex front edge being for the leg area. The combination of the blades and the handle providing a total shaving advantage for women greater than the handle and blade encountered separately.

DETAILED DESCRIPTION OF THE PREFERRED EMBODIMENTS

Figure 3:
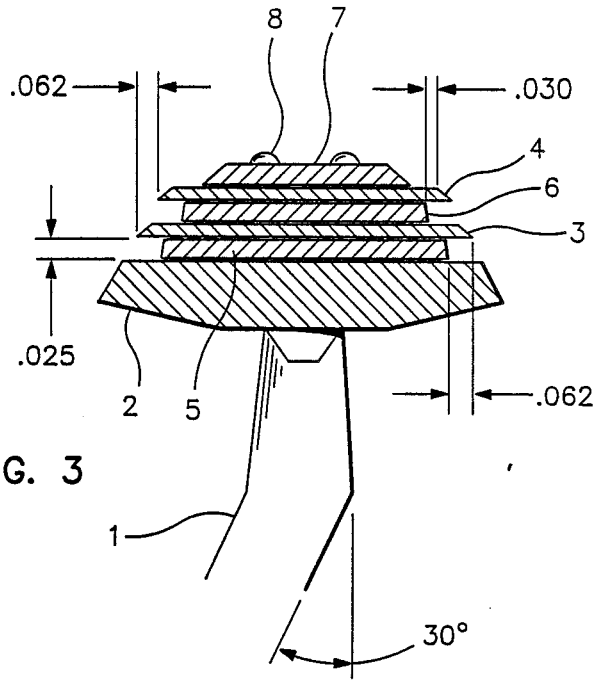
FIG. 3 is a section view through 1—1 of FIG. 2.
Figure 1:
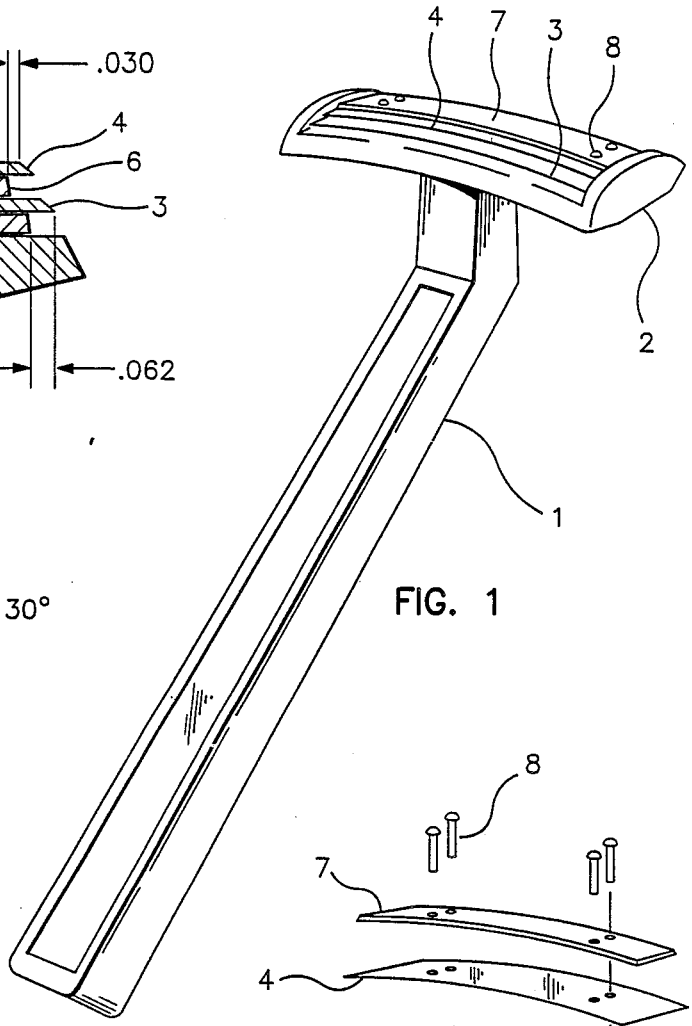
FIG. 1 is a front perspective view of the razor with contoured blades.
Figure 2:
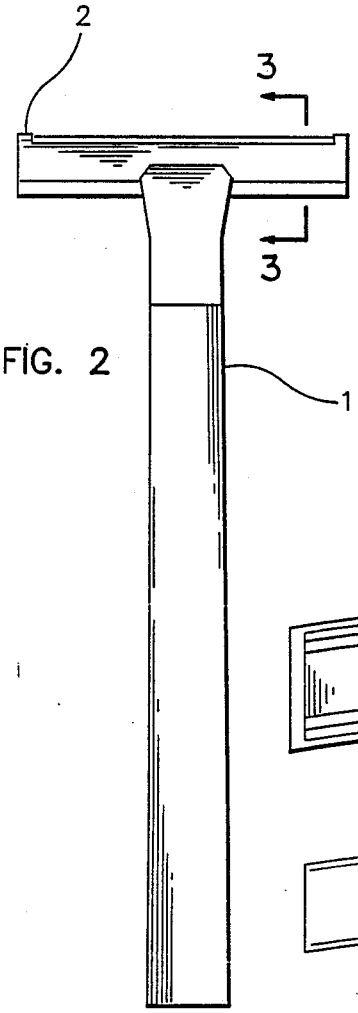
FIG. 2 is a back view of the razor with contoured blades.

Referring to FIG. 1 a contoured, twin blade razor with handle 1 and blade support head 2 is shown in a perspective view. FIG. 2 is a back view of the contoured blade razor. FIG. 3 is a sectional view through 1—1 of FIG. 2 showing the razor handle 1, the razor head base 2 with a first horizontal spacer element 5, a first contoured blade 3, a second spacer 6, a second contoured blade 4 and a top covering element 7. The spacer elements 5 and 6 being approximately .025 inches thick and of a depth sufficient to permit the contoured razor blades to extend approximately 0.062 inches from the spacers forward edge. The depth of the second contoured razor blade being approximately 0.125 less than the first contoured razor blade allowing the first razor blade to extend 0.062 inches beyond each edge of the second razor blade. The concave radius of the razor blades bottom edge being approximately 6.00 inch and the convex radius of the razor blade cutting edge being approximately 6.00 inches, with radii not necessarily being parallel in the stacked blade configuration.

Figure 4:
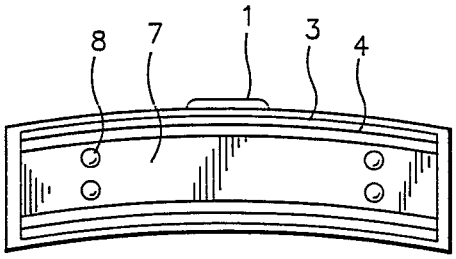
FIG. 4 is a top plan view of the razor with contoured blades.
Figure 6:
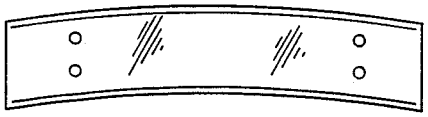
FIG. 6 is a plan view of a single blade.

FIG. 4 is a top plan view of the razor showing the relationship of the retainer plate 7, the razor head 2, the first razor blade 3, the second razor blade 4 and the covering element 7.

Figure 5:
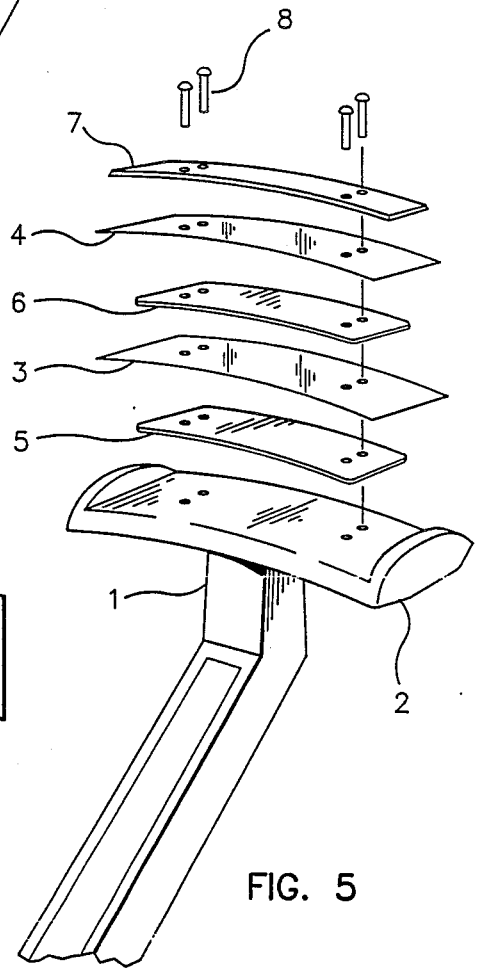
FIG. 5 is an exploded view of FIG. 5.

The exploded view of FIG. 5 shows the assembly sequence of the razor handle 1, the razor base 2, the final spacer 5, the first razor blade 3, the second spacer 6, the second razor blade 4 the retainer plate 7 and the vertical fastening rivets 8. A plurality of retainers, such as rivets 8 extend through the plurality of ports 9 and intimately secure the retainer plate 7, the blades 3 and 4 and the spacers 5 and 6 and the razor base 2.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A conventional shaving razor with one or more vertically stacked blades wherein the improvement comprises:

(a), the blades stacked vertically in uniform alignment;

(b), the blades separated by flat spacer element of a width less than that of the blade;

(c), the blades and spacers being of the same length;

(d), the upper blade of the stacked blades having a width less than that of the lower blade;

(e), the stacked blades covered by a retainer plate of less width than the top blade;

(f), the stack of blades plus the retainer plate secured to the razor base by a plurality of vertical rivets;

(g), each razor blade being double-edged with one cutting edge contoured convexly at approximately a six inch radius, and the other cutting edge contoured concavely at approximately a six inch radius;

(h), each stack of blades can have two differing radii within the same convex or concave assembly.

2. A shaving razor head comprising:

a. a plurality of blades stacked vertically in uniform alignment on a razor base;

b. the blades separated by a flat spacer element of a width less than that of the blade;

c. each succeeding blade having a width smaller than the adjacent lower blade;

d. a retainer plate having a width less than the topmost blade;

e. a plurality of ports through the razor base, the blades, the spacers and the retainer plate;

f. a plurality of retainers extending through the ports and intimately securing the retainer plate, the blades and the spacers to the razor base; and g. the razor blades being double-edged with one cutting edge being contoured longitudinally and convexly inward, and with the an other cutting edge contoured longitudinally concavely outward.

3. A shaving razor head as described in claim 2 further comprising a handle attached to the razor base.

4. A shaving razor head as described in claim 3 wherein the handle is attached to the razor base at an approximate angle of 25 to 35 degrees.

5. A shaving razor head as described in claim 2 wherein the blades and spacers are approximately the same length.

6. A shaving razor head as described in claim 2 wherein the double-edged blade edges are contoured on approximately a six inch parallel radius.

7. A shaving razor head as described in claim 2 wherein the double-edged blade edges are contoured on nonparallel radii.

8. A shaving razor head as described in claim 2 wherein the retainers are rivets.

9. A shaving razor head comprising:

a. a plurality of blades stacked vertically in uniform alignment on a razor base;

b. the blades separated by a flat spacer element of a width less than that of the blade;

c. each succeeding blade having a width smaller than the adjacent lower blade;

d. a retainer plate having a width less than the topmost blade;

e. a plurality of ports through the razor base, the blades, the spacers and the retainer plate;

f. a plurality of rivets extending through the ports and intimately securing the retainer plate, the blades and the spacers to the razor base;

g. the razor blades being double-edged with one cutting edge being contoured longitudinally and convexly inward, and with the an other cutting edge contoured longitudinally and concavely outward.

h. a handle attached to the base;

i. the blades and spacers having approximately the same length; and j. the front and rear blade edges contoured on approximately a six inch parallel radius.

10. A shaving razor head as described in claim 9 wherein the handle is attached to the razor base at an approximate angle of 25 to 35 degrees.

* * * * *